US005117746A

United States Patent [19]

Sharp

[11] Patent Number: 5,117,746

[45] Date of Patent: Jun. 2, 1992

[54] FUME HOOD SASH SENSING APPARATUS

[76] Inventor: Gordon P. Sharp, 89 Annawan Rd., Newton, Mass. 02168

[21] Appl. No.: 547,866

[22] Filed: Jul. 2, 1990

[51] Int. Cl.[5] ..... E08B 15/02

[52] U.S. Cl. ..... 454/61

[58] Field of Search ..... 98/115.1, 115.3

[56] References Cited

U.S. PATENT DOCUMENTS 4,528,898 7/1985 Sharp et al. ..... 98/115.3
4,706,553 11/1987 Sharp et al. ..... 98/115.3
4,893,551 1/1990 Sharp et al. ..... 98/115.3

*Primary Examiner*—Harold Joyce
*Attorney, Agent, or Firm*—Wolf, Greenfield & Sacks

[57] ABSTRACT

An apparatus for sensing the extent to which the sash or sashes covering the access opening of a fume hood are open. The apparatus includes a source of electromagnetic energy at a selected AC frequency below $10^6$ MHz, with a preferred frequency range being from 10 KHz to 100 KHz. The source preferably includes a wire coil connected to an oscillator of the selected frequency with the detector for the AC signal also preferably including a wire coil. Suitable elements are also provided for controliing the amount of electromagnetic energy from the source wire coil which reaches the detector wire coil as a function of sash opening. For the various embodiments, the apparatus may be arranged (a) with either one or both of the coils mounted in a fixed bar, control elements being mounted to the sashes; (b) with both coils mounted to sashes; or (c) with a single coil, either fixedly mounted or mounted to a sash, being used as both the source and detector coil, control elements being selectively mounted to the sashes. Embodiments which are variations on the three basic types discussed above are also provided.

39 Claims, 3 Drawing Sheets

FUME HOOD SASH SENSING APPARATUS

FIELD OF THE INVENTION

This invention relates to laboratory fume hoods and more specifically to apparatus for detecting the extent to which the sashes of a fume hood are open.

BACKGROUND OF THE INVENTION

A laboratory fume hood is a ventilated enclosure where harmful materials can be handled safely. The hood captures contaminants and prevents them from escaping into the laboratory by using an exhaust blower to draw air and contaminants in and around the hood's work area away from the operator so that inhalation of and contact with the contaminants are minimized. Access to the interior of the hood is through an opening which is closed with one or more sashes which may slide vertically, horizontally, or in both directions to vary the opening into the hood.

A conventional fume hood consists of an enclosure which forms five sides of the hood and a hood sash or sashes which slide horizontally and/or vertically to provide a variable-sized opening on the sixth side. In this type of hood, the amount of air exhausted by the hood blower is essentially fixed and the velocity of air flow through the hood opening, or face velocity, increases as the area of the sash opening decreases. As a result, the sash must be left open an appreciable amount even when the hood is not being used by an operator to allow air to enter the hood opening at a reasonable velocity. However, as is discussed in U.S. Pat. Nos. 4,528,898 and 4,706,555, the amount of energy required to deliver "make up air" may be reduced by monitoring the sash position, and thus the opening in the fume hood and by adjusting the blower and thus the exhaust volume of the hood linearly in proportion to the change in opening size in order to achieve a substantially constant face velocity. In these patents, the fume hood opening was covered by a single sash which opened in the vertical direction.

U.S. Pat. No. 4,893,551 discusses additional styles of fume hoods wherein two or more sashes are mounted to slide horizontally on at least two tracks which are located on the top and bottom of the sash opening and also fume hoods which have sashes mounted on tracks for horizontal movement, which tracks are, in turn, mounted on a sash frame which may be moved vertically. This patent also discusses techniques which may be utilized with such sashes to determine the sash opening. As is noted in this patent, with two or more sashes, absolute position of the sashes is not sufficient information by itself to indicate the open area of the hood. Instead, it is the relative position of the e two or more sashes of the hood which determine the total open sash area. The problem becomes even more complex where four sashes are mounted on two tracks, which is a very common configuration, or where the hood is being moved both horizontally and vertically.

In the U.S. Pat. No. 4,893,551 patent, the sash opening detection function is performed, in general, by having a source of radiation, and a detector for such radiation, and by mounting the source and detector relative to each other and to the sashes such that the amount of radiation detected is proportional to the uncovered portion of the opening. For preferred embodiments in the patent, various discrete magnetic or optical emitters and sensors mounted adjacent to or on the sashes are utilized to determine the fume hood opening.

However, the detectors, and in some cases the sources, for these preferred embodiments utilize active devices which may need to be installed inside or near the opening of the fume hood. This results in a need for careful sealing of these devices with the attendant cost and complexity. These active devices, and even some of the nonactive devices disclosed in the patent, also require an enclosure having a reasonable thickness, particularly when sealing is required. This can cause problems in locating such devices on the sashes of some hoods. In particular, such devices may not fit within the clearance between the sashes or between the sashes and the frame of the hood.

Further, the preferred embodiments in the patent utilize a number of discrete components, and, therefore, provide discrete outputs rather than a continuous output. The degree of precision with such apparatus depends on the number of sensors utilized and is generally hot better than about one-half inch. Even to achieve this degree of precision, a large number of discrete sources and detectors are required which results in the apparatus being relatively complex and expensive. The increased number of apparatus also results in an enhanced likelihood of component failure.

A need, therefore, exists for improved embodiments for such fume hood sash sensing apparatus which do not require the use of active devices and which may be fabricated to be very thin. It would also be desirable if at least some such embodiments could provide continuous rather than discrete outputs. Finally, it would be desirable if discrete components could be substantially eliminated so as to enhance the reliability of the apparatus.

SUMMARY OF THE INVENTION

In accordance with the above, this invention provides apparatus for sensing the extent to which the sash or sashes covering the access opening of a fume hood are covering the opening. The apparatus includes a source of electromagnetic energy at a selected AC frequency below $10^6$ MHz. The source includes a transmitting element selectively mounted relative to the sashes, and means responsive to the electromagnetic energy and to the positions of the sashes for generating an electrical signal which varies as a function of the uncovered portion of the opening. The signal preferably varies substantially continuously as a function of the uncovered portion of the opening and the frequency range for the electromagnetic energy is preferably in the range from 10 Hz to 200 MHz. The most preferred frequency range is from 10 KHz to 100 KHz.

For a preferred embodiment, the source of electromagnetic energy includes a wire coil connected to an oscillator of the selected frequency. The means for generating the electrical signal also preferably includes a wire coil detector for detecting energy at the selected frequency and a means for controlling the amount of electromagnetic energy from the source wire coil which reaches the detector wire coil as a function of sash position. At least one of the coils may be mounted in a bar which extends substantially across the opening and is adjacent the sashes.

There are three basic ways in which the apparatus may operate. The first way is for the coils to be mounted stationary with electromagnetic energy sinks/shields or electromagnetic path permeability enhancers mounted to the sashes in a manner such that the energy reaching detector coils from source coils either increases or decreases as a function of sash opening. The source and detector coils may either be mounted in the same bar on one side of the sashes, in separate bars on the same side of the sashes, or in separate bars on opposite sides of the sashes.

The second way is for either the source or detector coil to be stationary with the other coil mounted to the sashes or for one type of coil to be mounted to some sashes and the other type of coil to be mounted to the remaining sashes. In either event, the output signal will vary as a function of relative sash position and thus of sash opening.

The third technique is to have only a single coil which functions as a source, or as both a source and detector, and to control the voltage across or current flow in the coil as a function of the uncovered portion of the opening by use of loading coils or conductive or magnetically permeable strips. The source coil may either be fixedly mounted or mounted to the sashes and the loading coil or the strips either fixedly mounted (or forming part of the hood frame), or, where the source coil is fixedly mounted, may be mounted to the sashes. A means is also provided which is responsive to the voltage/current variations on the coil for controlling the opening indicating electrical signal.

At least one of the wire coils may be coiled in multiple sections and one or more of the sections may be removable to achieve a coil of a desired length without breaking the continuity of the coil. The coil sections may be connected in series with means being provided for making electrical connection to remaining end sections of the coil or the coil sections may be connected in parallel. Where the coil sections are connected in parallel, separate threshold detector means may be provided for each coil section so that discrete outputs can be obtained.

For preferred embodiments, either one or both of the coils are coiled flat. The coils are preferably in the form of conductive film deposited on a substrate. Where greater directivity from a transmitting coil is required, the coil may be wrapped on a coil form of a magnetically permeable material to enhance the electromagnetic energy.

The foregoing and other objects, features and advantages of the invention will be apparent from the following more particular description of preferred embodiments of the invention as illustrated in the accompanying drawings.

IN THE DRAWINGS

DETAILED DESCRIPTION

Figure 1:
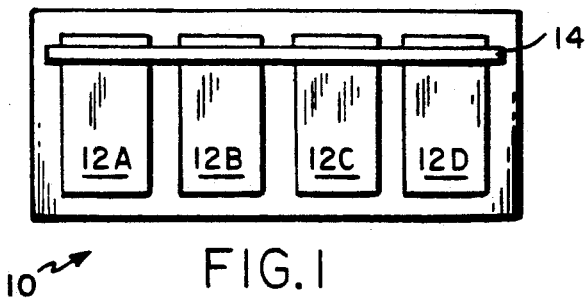
FIG. 1 is a front view of a fume hood having horizontally mounted sashes and having a detector bar of a type utilized in this invention.

FIG. 1 shows an exemplary fume hood 10, the front opening of which is covered by four horizontally-mounted sashes 12A–12D. As is discussed in greater detail in the before-mentioned U.S. Pat. No. 4,893,551, the sashes 12 are typically mounted on two tracks with sashes 12A and 12C being mounted on one track and sashes 12B and 12D being mounted on another track so that adjacent sashes overlap when the sashes are open. In accordance with the teachings of this invention, the relative positions of the sashes 12, and thus the extent to which the fume hood opening is uncovered, may be measured in a variety of ways, some of which use a horizontally mounted bar 14 which may contain sensing or detecting elements. Bar 14 is fixed to the housing of hood 10 and extends across the entire hood opening, including all of the sashes 12. The exact horizontal position of bar 14 relative to the sashes is not critical; however, the bar should be either near the top of the sashes, as shown in FIG. 1, or near the bottom of the sashes so as to minimize interference with access to the hood through the opening.

Figure 2:
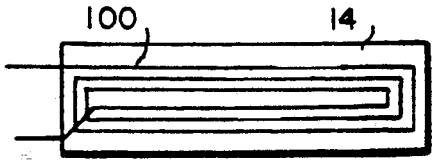
FIG. 2 is a front view of a multiturn coil suitable for use as an electromagnetic energy source or as a detector coil in preferred embodiments of the invention.
Figure 3:
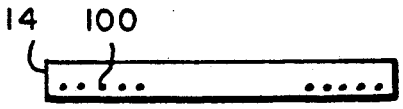
FIG. 3 is a cross-sectional view taken along the line 3—3 in FIG. 2 of a single layer thin coil which is suitable for use as either a source coil or detector coil in accordance with the teachings of this invention.

FIG. 2 is a front view of a bar 14 for a preferred embodiment of the invention wherein the bar contains a multiturn wire coil 100. The coil 100 may be utilized as either a source coil when connected to a suitable oscillator or may be utilized as a detector coil when connected to a suitable receiving circuit. As illustrated in FIG. 3, which is a cross-sectional view taken along the line 3 3 in FIG. 2, the coil 100 is preferably of single layer thickness. To obtain very thin detector bars suitable for use in some embodiments of the invention, the coil 100 could be a conductive film printed on a substrate, on Mylar plastic film or on some other suitable material utilizing standard printed circuit technology.

As will be discussed later, the number of turns on coil 100 will vary with factors such as spacing of source and detector coils, frequency, oscillator power and the like. In some applications, one of the coils may have a single turn or possibly even a partial turn.

In accordance with the teachings of this invention, it has been found that the detection function can be advantageously performed utilizing coils 100 where a source coil is connected to an oscillator oscillating at an AC frequency which is generally in the RF frequency range. This would typically be at a frequency below $10^6$ MHz which is the frequency range below infrared. While energy may be transmitted more efficiently in the higher frequencies of this range, permitting smaller coils 100 to be utilized both for the source and the detector, and permitting lower power oscillators to be utilized, such higher frequency signals also present a number of problems. The very high frequencies, above 200 MHz, are expensive to generate and both difficult and expensive to control. For at least these reasons, such very high frequencies would not generally be utilized for the application of this invention. The problems of the higher frequencies include the creation of RF interference with other equipment which may be present in the laboratory or with reception on radio or television receivers and the possibility that the detector coil for the apparatus may also pick up stray RF signals from other equipment at the facility or from transmitters in the area. Since, for this application, signals are being transmitted over only a few inches at most, the higher transmitting efficiencies of the high frequency signals are generally not required. Therefore, for preferred embodiments, it is contemplated that the apparatus will operate at the lower end of the indicated frequency range to minimize the likelihood of either creating RF interference or of obtaining spurious inputs as a result of such interference. However, very low frequencies, for example, below 10 to 20 Hz, would also not generally be utilized because of the high power, and thus expensive generators, required at such frequencies. A suitable operating frequency range might therefore be from 10 Hz to 200 MHz with the preferred frequencies for operations being in the range of 10 KHz to 100 KHz.

Figure 4:
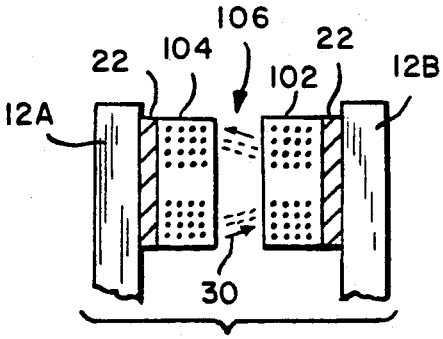
FIG. 4 is a cross sectional view of an embodiment of the invention involving both transmitting coils and receiving coils which are attached to sashes.

In general, the invention performs the sash opening detection function utilizing three related techniques. The first technique which is, for example, illustrated by FIG. 4, is to mount a source coil to one sash which is on one track and a detector coil to a second sash which is on a different track. The relative overlap of the two coils provides an indication of the relative position of the two sashes and thus of sash opening.

Figure 7:
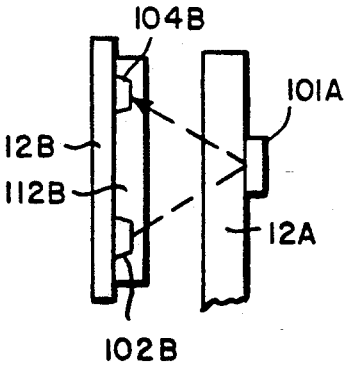
FIG. 7 is a schematic side view of an embodiment of the invention wherein both a source coil and a detector coil are mounted in a common bar.

The second general technique is illustrated, for example, by FIG. 7 where a source coil and a detector coil are mounted in a bar, such as a bar 14 which is fixed to a sash, with an electromagnetic energy shield or an electromagnetic energy enhancer being mounted to another sash. For embodiments where the source/detector bar is mounted to a sash, the shield/enhancer may possibly be mounted in a stationary bar. The difference in the energy received at the detector depending on the amount by which the source/detector bar overlaps the shield/enhancer bar is an indication of sash opening. A variation on the approach shown in FIG. 7 is that shown in FIGS. 9 and 10 where the source bar and the detector bar are on opposite sides of the sashes, with what is generally an EMF shield affixed to the sashes.

Figure 14:
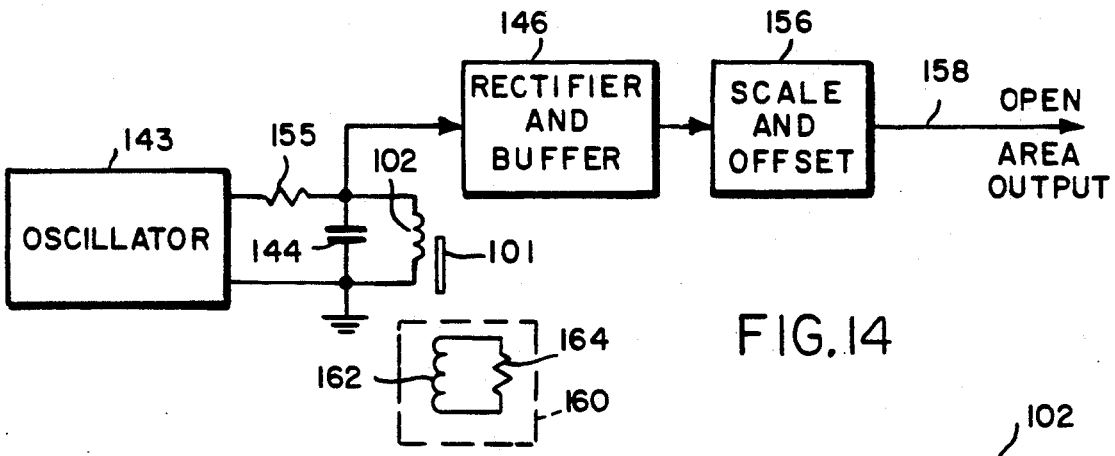
FIG. 14 is a semiblock schematic diagram of a circuit for a variable voltage current embodiment.

The third approach is illustrated by FIG. 14 and involves mounting a coil to a fixed bar or to selected sashes and mounting an EMF sink, shield or enhancer such as a coil, a conductive strip or magnetically permeable strip either to other sashes, or to a bar where the coil is not mounted to sashes. The variations in the position of the sink, shield or enhancer relative to the coil as the sashes are moved results in a change in the voltage across or current flow through the coil which may be detected and provides an indication of the degree of overlap between the coil and the EMF sink/shield/enhancer, and thus of the hood opening.

Referring more particularly to FIG. 4, a transmitting coil 102 is shown attached by a suitable adhesive 22 or other suitable means to a sash 12B which is on one track and a receiving coil 104 is shown attached to a second sash 12A on a second track by an adhesive 22 or other suitable means. The coils 102 and 104 would normally be contained in a suitable bar or other container which is preferably sealed and/or encapsulated. Electromagnetic energy 30 from coil 102 passes through the gap 106 between the coils inducing an electromagnetic signal in coil 104 which may be picked up by suitable receiving apparatus which will be discussed later.

Figure 5:
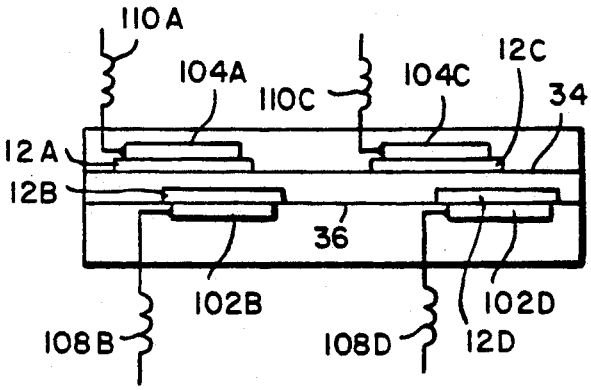
FIG. 5 is a top view of a four sash embodiment of the invention wherein both the source and the detector bars are mounted to the sashes.

FIG. 5 is a top view of a four sash embodiment of the invention employing the technique of FIG. 4. For this embodiment of the invention, two of the sashes, sashes 12A and 12C, are on a rear track 34 and two of the sashes, sashes 12B and 12D, are on a front track 36. For purposes of illustration, transmitters 102B and 102D are shown as being attached to sashes 12B and 12D, respectively, with receiving coils 104A and 104C being attached to sashes 12A and 12C, respectively. A wire pair 108 extends from each transmitting coil 102 and a wire pair 110 extends from each receiving coil 104.

Figure 6:
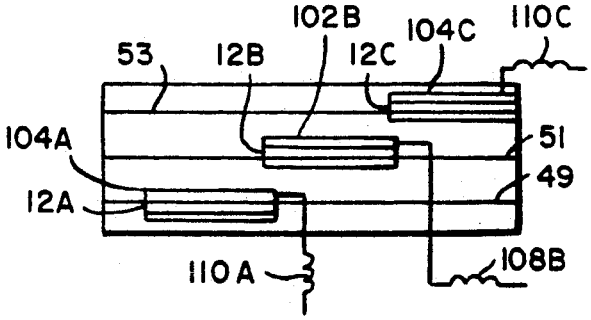
FIG. 6 is a top view of a three sash embodiment of the invention wherein both the source coil and the detector coils are mounted to sashes.

FIG. 6 shows a similar embodiment of the invention being utilized with a three sash hood where the sashes 12A, 12B and 12C are mounted on tracks 49, 51 and 53, respectively. For this embodiment of the invention, there is a single transmitter coil 102B which is mounted to the middle sash 12B and two receiving coils 104A and 104C which are mounted to the sashes 12A and 12C, respectively. Wire pair 108B is connected to coil 102B and wire pairs 110A and 110C are connected to receiving coils 104A and 104C, respectively.

The embodiments of the invention shown in FIGS. 4, 5 and 6 may be implemented using single layer printed conductor circuits such as those shown in FIG. 3, rather than the multilayer coils shown in FIG. 4. Further, while transmitter coils have been shown on outer track 36 in FIG. 5 and receiver coils on inner track 34, the transmitter and receiver coils may, in fact, be positioned on either track. An advantage of the embodiment shown in FIG. 6 is that, since the transmitter coil transmits in both directions, only a single transmitter coil is required for a three sash embodiment. However, care must be exercised to space the two receiving coils at the same distance from the transmitter coil to assure consistent results, or one of the scaling or sensitivity reducing techniques discussed later must be used. With these embodiments, the output is minimum when the hood opening is closed and there is no overlap, and increases linearly as the degree of overlap (and thus the size of the opening) increases.

Two disadvantages of the embodiment of the invention shown in FIGS. 4–6 are that electrical connections must be made to all of the moving sashes and that the coils are positioned in the fume hood opening where they may be subjected to contaminants or temperature variations which may affect their life or operation. However, since the only thing mounted to the sashes are passive coils which, particularly when implemented as printed circuit components, may be easily encapsulated while still providing a very thin profile, this is not as much of a problem as it would be for the active component embodiments of, for example, U.S. Pat. No. 4,893,551.

Figure 11:
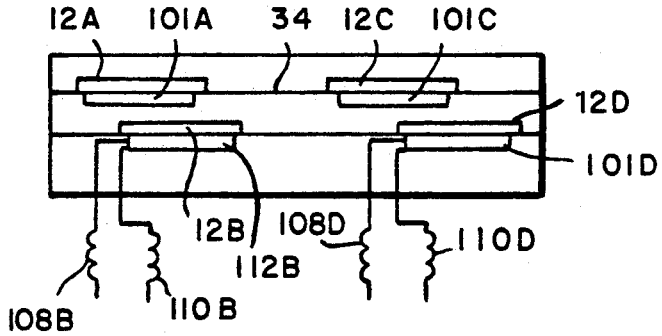
FIG. 11 is a top view of a four sash embodiment of the invention wherein both the source coil and the detector coil are mounted to the same sashes.

FIG. 7 illustrates an alternative embodiment of the invention, a top view of which is shown in FIG. 11. In FIG. 7, a bar 112B containing both a transmitter coil 102B and a receiver coil 104B is mounted to a sash 12B. An electromagnetic flux altering element 101A is mounted parallel to the bar 112 on sash 12A. Energy altering element 101 may be a strip of conductive material which serves as a shield for electromagnetic energy, reducing the electromagnetic energy from transmitter coil 102B which is received by receiving coil 104B, or may be an electromagnetic energy enhancer, such as a bar or strip of magnetically permeable material which effectively reduces the impedence (i.e. increases the permeability) of the electromagnetic path between transmitter coil 102 and receiver coil 104. This results in an increased output at coil 104 when an enhancer element 101 is adjacent bar 112. A magnetically permeable bar may also act as an EMF shield if positioned to divert energy from detector coil 104 rather than toward the detector coil. In either event, the electromagnetic energy from coil 102 which is received at coil 104 is altered when an element 101 is adjacent the coils in a predictable manner which may be detected to provide an indication of the relative position of the sashes and thus of the sash opening. Thus, in FIG. 11, the bars 112B and 112D are affixed, respectively, to sashes 12B and 12D mounted on front track 36 while energy altering elements 101A and 101C are mounted to sashes 12A and 12C on rear track 34. Lines 108 and 110 provide signal to and receive signal from the coils 102 and 104, respectively.

While FIG. 7 shows coils 102 and 104 being mounted in a common bar 112, it is apparent that these coils could also be mounted in separate, adjacent mounted bars. The length of the shield/enhancer strips 101 are generally substantially equal to the width of the sash. The width of the strips can vary, but should be wide enough to have a detectable effect on the EMF. A width approximately equal to the width of the detector coil gives good results if the source and detector coils are reasonably close. Further, in some applications, with the coils suitably positioned, a portion of the sash itself or of the hood frame may be utilized, for example, as a shield in lieu of a strip 101.

Figure 8:
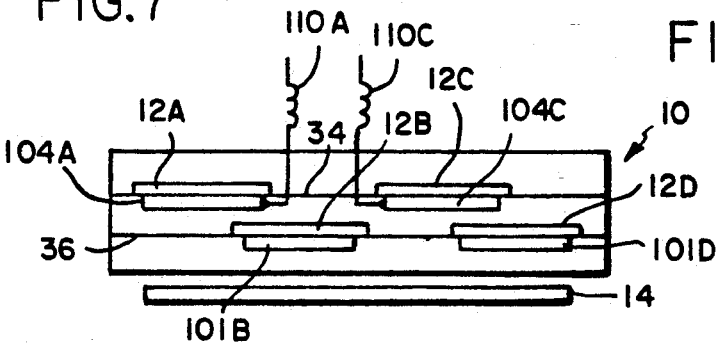
FIG. 8 is a top view of a four sash embodiment of the invention wherein one set of coils is fixed and one set of coils are movable and mounted to selected sashes.

FIG. 8 shows an embodiment of the invention which is similar to that of FIG. 11, except that transmitter coil 102 is positioned in bar 14 mounted to the front of hood 10, with receiving coils 104A and 104C being mounted to sashes 12A and 12C on rear track 34. Energy altering elements 101B and 101D are mounted to sashes 12B and 12D, respectively. For this embodiment of the invention, elements 101 would typically be energy shields such as conductive strips which would function to block or shield the transmission of electromagnetic energy from the transmitter coil to the receiving coils when a sash on front track 36 overlaps a sash on rear track 34. It is, of course, apparent that while in FIG. 8 transmitting coil 102 has been shown in stationary bar 14 and receiving coils 104 have been shown mounted to the sashes, this is for purposes of illustration only, and it is equally within the contemplation of the invention that a receiving coil be mounted in bar 14 and transmitting coils be mounted to sashes 12A and 12C. With this embodiment of the invention, the output is maximum when there is no overlap of the sashes, or in other words, when the opening is completely closed, and is reduced by an amount directly proportional to sash overlap which, in turn, varies as a function of hood opening.

Figure 9:
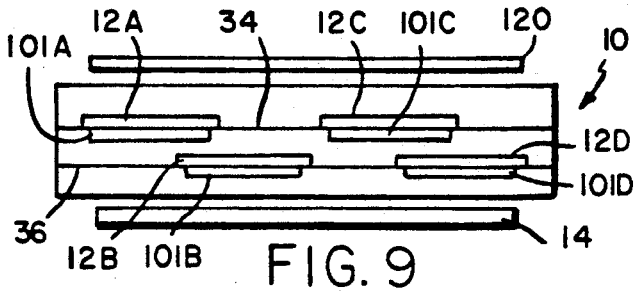
FIG. 9 is a top view of a four sash embodiment of the invention utilizing separate bars for the source coil and the detector coil, which bars are positioned on opposite sides of the sashes.

FIG. 9 shows an embodiment of the invention which is similar to that of FIG. 8 except that rather than having the receiver coils mounted to sashes, the receiver coils are mounted in a stationary bar 120 which is positioned parallel to the bar 14 containing the transmitting or source coil 102, but on the opposite side of sashes 12. An energy altering element 101, preferably an energy shield such as a metal strip, is connected to each of the sashes 12. This results in reduced EMF energy reaching the receiving coil in bar 120 when there is no overlap of the sashes and the sash opening is completely closed, with increasing amounts of EMF energy reaching the receiver coil as the sashes are opened. A significant advantage of the embodiment of the invention shown in FIG. 9 is that it does not require any wiring to be connected to the moving sashes.

Figure 10:
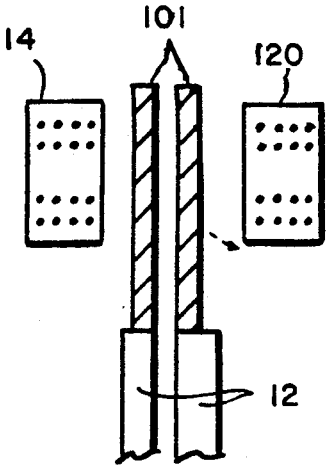
FIG. 10 is a sectional side view of an embodiment of the invention having two bars as for the embodiment of FIG. 9 which are positioned above the sashes with flags on top of the sashes.

FIG. 10 shows an embodiment of the invention which functions in the same way as that of FIG. 9, except that the energy shield strips are mounted as flags to the top of the sashes 12 rather than to the side of the sashes. The bars 14 and 120 are also mounted in the fume hood frame above the sashes. The sensing apparatus is thus positioned out of the fume hood opening where it is less obtrusive in gaining access to the hood and is also less subject to contaminants from the hood which may float through the opening. While the cross section shown in FIG. 10 has multilayer coils in the bars 14 and 120, it is to be understood that single layer printed conductor circuit coils might be utilized in this application so as to take up as little space as possible in the fume hood frame, space frequently being at a premium in this area.

One potential problem with the embodiments shown in FIGS. 9 and 10 is that there may be a substantial separation between the transmitting coil in, for example, bar 14 and the receiving bar in, for example, bar 120. However, utilizing the sash sensing technique of this invention, this separation is not a problem since the power necessary to span this gap can be obtained through a combination of one or more of the following:

1. The oscillator power can be increased to a desired level to increase the EMF output from the source coil 102.

2. The output from the source coil can also be increased by increasing the number of turns on the coil.

3. For a given oscillator power, the EMF output can be increased by increasing the frequency at which the oscillator, and thus the system, operates. This would involve tuning both sides of the circuit to a new higher frequency.

4. The sensitivity of the receiving coil can be increased by increasing the number of turns on the receiving coil.

Thus, separation between the two coils is not a problem and this embodiment of the invention, which is the preferred embodiment for some applications, becomes far more feasible than it would be utilizing some of the prior art techniques.

It is also possible to enhance the output for the embodiments of FIGS. 9 and 10 by reducing the reluctance of the EMF path between the coils. Thus, strips of magnetically permeable material may be used as the strips 101 resulting in a reduced reluctance path, and thus higher output when the strips are between the coils.

Figure 12:
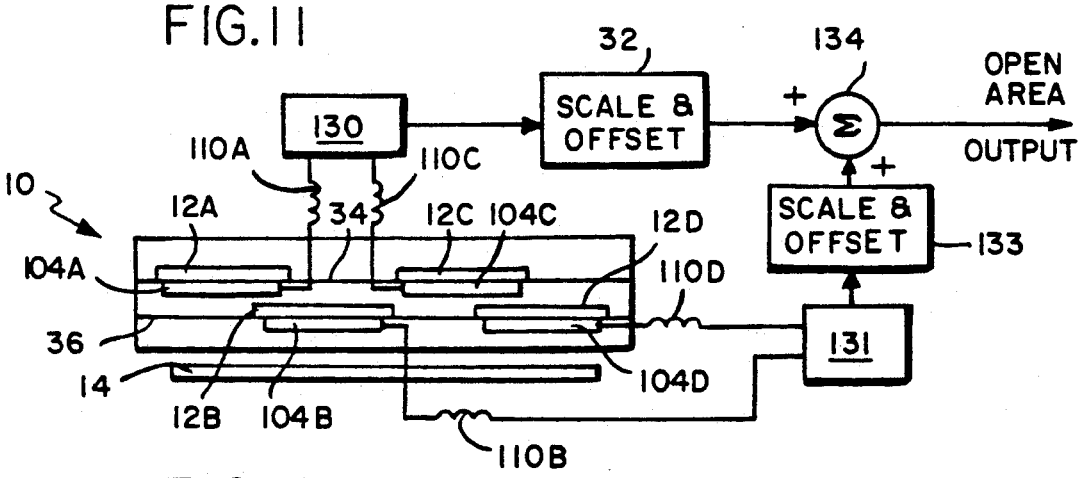
FIG. 12 is a top view of a four sash embodiment of the invention having a source coil bar and detectors on the sashes, where the sashes are at variable distances from the source coil bar and including a schematic block diagram of a compensation circuit for use in such embodiment.

In many of the embodiments which have been heretofore discussed, and in particular various embodiments utilizing the energy altering elements, an indication might be provided of sash opening, but not of whether a sash is actually in the hood or has been removed. FIG. 12 illustrates a more foolproof system wherein a detector coil 104 is provided on each sash. For purposes of illustration, it will be assumed that bar 14 contains a transmitter coil and that there is a receiver coil 104 on each of the sashes 12. This provides an output for each sash and indicates whether a sash is present or not.

However, as can be seen from FIG. 12, the receiver coils 104 mounted to sashes 12A and 12C on rear track 34 are at a greater distance from the transmitting coil in bar 14 than are the receiving coils mounted to sashes 12B and 12D on front track 36. This results in greater outputs from the coils 104B and 104D than from the coils 104A and 104C when the coils are in front of the transmitter coil. To compensate for this difference in signal, the output lines 110A and 110C from receiver coils 104A and 104C are connected to first detector circuits 130, which are basically a tuned receiver, rectifier and amplifier, an example of which will be described shortly, while the output lines 110B and 110D from the receiver coils 104B and 104D, respectively, are connected to separate detector circuits 131. The outputs from circuits 130 and 131 are applied through separate scale and offset circuits 132 and 133, respectively, which compensate for threshold levels at the receiver coils and scale the outputs by, for example, amplifying the outputs from detectors 130 to compensate for the differences in distance from the transmitting coil. The outputs from the two scale and offset circuits are summed in a summing circuit 134 to provide a signal on line 136 which is indicative of sash opening. The circuit shown in FIG. 12 may be simplified in several ways. First, it is noted that receiver coils 104C and 104D are always in front of the transmitter regardless of sash opening so that the outputs from these coils merely indicate whether the sash is present and are not indicative of sash opening. Therefore, the outputs from these coils could be compared against a threshold and used only to indicate whether the sashes are present, while the outputs from the coils 104A and 104C are used as an indication of sash opening. Under these circumstances, scaling would not be required. Further, as previously indicated, receiver sensitivity or output level can be enhanced by adding turns to the receiver coil. Turns could be added to coils 104A and 104C until it is determined, either mathematically or empirically, that the outputs from the coils on the front and rear track are matched regardless of the distance of the receiving coil from the transmitter coil.

Figure 13:
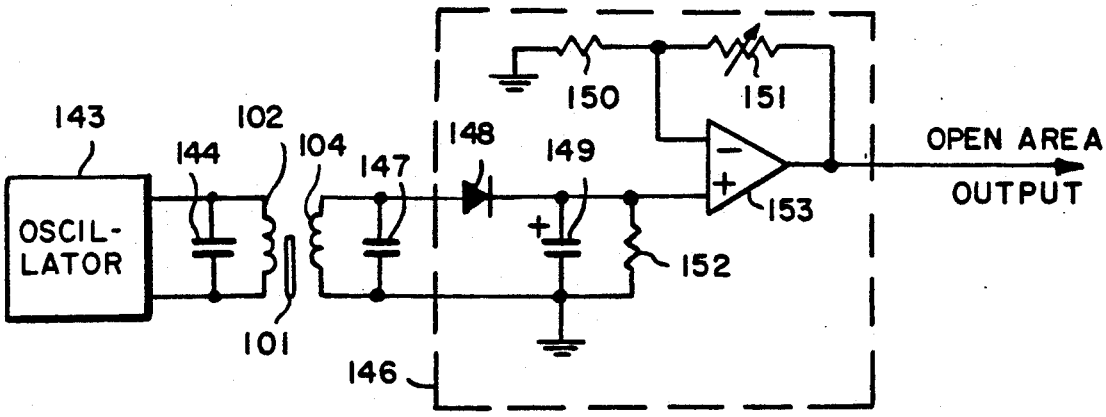
FIG. 13 is a schematic, semiblock diagram of electronic circuitry suitable for use with the source coil and detector coil of various embodiments of the invention.

FIG. 13 illustrates an oscillator and detector circuit which might be utilized, for example, with an embodiment of the type shown in FIGS. 9 and 10. The oscillator and detector circuits would be similar for other embodiments. In FIG. 13, an oscillator 143 is provided which generates a signal of a selected power at a selected frequency. It is preferable that oscillator 143 be a sine wave oscillator, such as a wien-bridge oscillator or other sine wave oscillator known in the art, rather than a square wave oscillator. This is because square wave oscillators have increased harmonics which increase the radio frequency interference. However, the oscillator 143 may include in some applications a square wave oscillator whose output is passed through a low pass filter before being applies to the coil 102. The source coil 102 can optionally be tuned with a tuning capacitor 144. Depending on the type of oscillator used, the tuning capacitor 144 and source coil 102 can be included within the oscillator circuit. The desired frequencies for the oscillator have been previously discussed.

The EMF from coil 102, to the extent it is not altered by element 101, produces an induced EMF signal in detector coil 104. An optional tuning capacitor 147 can be used to boost the output of coil 104 by tuning the LC time constant of the receiving circuit to match the frequency of oscillator 143.

The output signals from the tuning circuit are applied to a rectifier and amplification circuit 146. Many forms of standard circuits for performing this function might be utilized, the circuit shown in FIG. 13 being exemplary of such circuits. The circuit 146 includes a simple half wave rectifier consisting of a rectifier diode 148, a filter capacitor 149 and a load resistor 152. A non-inverting buffer amplifier 153 is used to sense and buffer the filter signal across capacitor 149. The open area output from the circuit at the output from amplifier 153 is a voltage signal, the amplitude of which is proportional to the induced EMF in coil 104 The gain of amplifier 153 can be varied by fixed resistor 150 and variable resistor 151 to compensate for signal strength variations, as a result of the variable separation between coils for hoods from different manufacturers or for other reasons. Other forms of compensation known in the art might also be utilized, either in addition to or in place of the resistors 150 and 151.

Where there are two or more detector coils 104, the outputs from the circuits 146 may be connected in series or parallel to obtain an indication of sash opening or the coils may themselves be connected in series before application to a circuit 146, or may be connected in parallel with the use of slightly different compensation currents. Other forms of interconnections might also be possible.

Unless some type of complex compensation is provided, where the coils 104 are connected in series, it is important that the coils be substantially identical in size, shape, number of turns and distance from the transmitting coil so that any differences in output will be solely a function of sash opening and not of coil variation. This would generally also be true where the coils are connected in parallel, although compensation for variations might be easier with this form of connection.

Since the detector coil 104 may also pick up extraneous RF radiation, some form of filtering is advisable to reject frequencies other than that of oscillator 143. While a low pass filter could be utilized to perform this function, a band pass or notch filter is preferable. Filtering is, to some extent, performed by the tuned combination of coil 104 and capacitor 147. To the extent additional band pass filtering is desired, it can be achieved utilizing circuits well known in the art.

In the discussion to this point, a separate transmitting coil 102 and a separate receiving or detector coil 104 have been utilized for each embodiment of the invention. However, as is well-known in the art, the voltage across current flowing through a coil may be varied by varying the coil impedance or by varying the loading on the coil. Such variations may be effected in a number of ways and may be detected in a number of ways. For example, the embodiment shown in FIGS. 7 and 11 might be modified so that the bar 112 contains only a single coil 102, with this coil having its impedance varied or being loaded by an adjacent strip of conductive or magnetically permeable material 101 or an adjacent secondary coil in a load circuit. FIG. 14 shows a circuit which might be utilized to perform the signal generation and detection function for such an embodiment.

Referring to FIG. 14, the circuit includes an oscillator 143 which would generally be the same as the oscillator 143 shown in FIG. 13. Oscilltor 143 drives coil 102 through resistor 155. A tuning capacitor 144 may be utilized to enhance the output from the oscillator. Resistor 155 forms a voltage divider with the tuned LC circuit.

For some embodiments, as a magnetically permeable or electrically conductive strip 101 passes in front of coil 102, the voltage across the coil changes due to an impedance change in coil 102. This variation in voltage of the voltage divider, which also results in a variation in current output, is rectified and buffered by the circuit 146, which may be the same as the circuit 146 shown in FIG. 13. The output from circuit 146 is passed through a scale and offset circuit 156 to output line 158. Scale and offset circuit 156 offsets or nulls out the normal signal level across coil 102. The added gain capability of this circuit can be used to get a larger signal or to properly scale the output.

Element 101 adjacent coil 102 also affects the inductance, and thus the impedence, of coil 102. This change in inductance with changes in the relative position of the coil 102 and element 101 may change the time constant and thus the frequency of the circuit with capacitor 144. This frequency change may be detected and used as an indication of hood opening.

The circuit in dotted box 160 illustrates an alternative embodiment wherein a secondary coil 162 is connected in series with an impedance load illustrated by resistance 164 in place of strip 101. The circuit 160 provides a variable load to coil 102 resulting in variations in the voltage across or current flow therein with the degree of coil overlap.

It might also be possible to construct a variable impedance system of the type shown in FIG. 14 utilizing a configuration such as that shown in FIG. 9, with the bar 120 being omitted. Under these circumstances, the effects caused by elements 101B and 101D would be constant, regardless of sash position, and could be utilized as part of the offset, with the effects from coils 101A and 101C being utilized to determine sash opening.

Other apparatus known in the art which utilize variable reluctance concepts could be utilized in place of the circuit shown in FIG. 14. Such circuits include LVDT (linear variable differential transformer) circuits which are similar to the two coils in a single bar approach shown in FIG. 7, except two sensing coils and one transmitting coil are employed to get a null condition when an energy altering element 101 is centered in front of the LVDT bar.

Figure 15A:
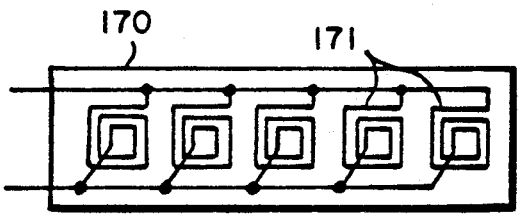
FIG. 15A is a front view of a multicoil embodiment of the invention where the coils are connected in parallel.

FIG. 15A illustrates a coil bar 170 which differs from, for example, that shown in FIG. 2 in that the coil is formed as a plurality of parallel connected sections 171 rather than as a single continuous coil. The advantage of the configuration shown in FIG. 15A is that the bar 170 can be fabricated in a single length and can then be cut to fit a desired fume hood sash. This is desirable since there are wide variations in the size of fume hood sashes and, without a configuration such as that shown in FIG. 15A, it would be necessary to have a large inventory of customized bars for the different fume hood sash sizes.

Figure 15B:
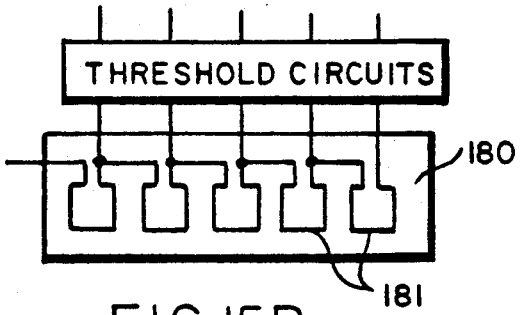
FIG. 15B is a front view and semiblock schematic diagram of a multicoil embodiment of the invention wherein the coils are connected in series.

FIG. 15B shows a bar 180 with separate coil segments 181, which segments are connected in series. A tab extends from each coil 181 so that the bar 180 may be cut to size in the same manner as the bar 170 without loss of continuity.

FIG. 15B also illustrates another alternative structure which may be desirable in some applications. For the embodiments of the invention discussed to this point, the outputs from the coil have been continuously variable depending on sash position. While this sensitivity in many instances is desirable, it may also lead to spurious outputs in some situations, either as a result of stray signals or as a result of variations in distance caused by, for example, rattling of the sashes in the frame or the like. The multiple coil segment embodiment of FIG. 15B may thus have the output from each coil segment attached to a threshold circuit which generates an output only when the signal from such coil exceeds a predetermined threshold level. The outputs from the threshold detectors would be summed, as in the prior patent, to obtain a single output signal indicative of sash opening. Multiple discrete outputs are thus obtained which are a function of sash position and assure that spurious outputs do not occur. However, since the bar 180 may be fabricated utilizing printed circuit technology, a large number of coil segments may be provided in bar 180 without appreciably increasing the cost of the bar, providing any desired degree of sensitivity at relatively modest cost.

Figure 17:
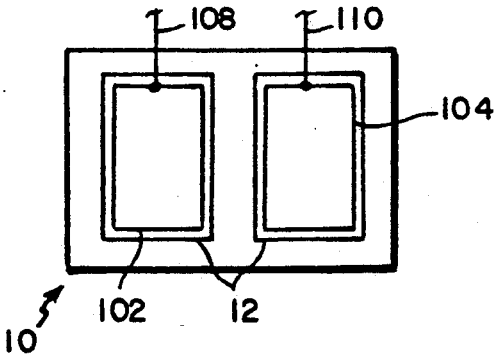
FIG. 17 is a front view of an embodiment of the invention wherein an enlarged detector coil is utilized.

FIG. 17 illustrates still another way in which the sensitivity of the coils to distance change variations may be slightly reduced to eliminate spurious outputs. It is known that the larger the receiving coil is, the greater its output, the lower its sensitivity to distance variations. Thus, in FIG. 17, the coils 102 and 104 are shown mounted to cover substantially the entire outer perimeter of the sash rather than being contained only in a narrow bar. This is a relatively simple way to reduce the sensitivity to spurious outputs.

While the advantageous results achieved by increasing coil width are maximized where the coil covers most of the sash, this is not a limitation and advantageous results can be achieved with narrower coils.

One or more of the coils could also be in the form of a flexible ring, the length of which is varied to fit any sash width, with the coil width varying inversely with the coil length.

Figure 16A:
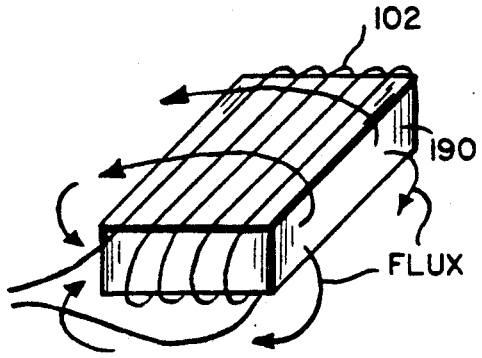
FIGS. 16A–16C are diagrams of various source coil embodiments employing a coil form to enhance focusing of the electromagnetic energy.
Figure 16B:
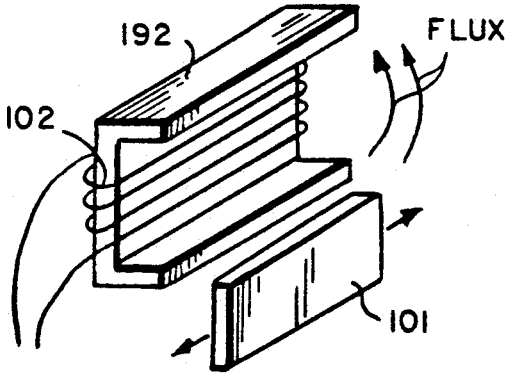

One potential problem, as previously discussed, with the apparatus of this invention is that it may generate spurious EMF output which may interfere with other equipment in the area. One way to reduce such spurious EMF output is to focus the EMF energy at the detector coil 104. In the simplest form shown in FIG. 16A, the coil 102 is wrapped on a bar coil form 190. The coil form would be formed of a magnetically permeable material. Better results can be obtained by using a standard "C" coil form 192 such as that shown in FIG. 16B. A magnetically permeable piece of material 101 may be utilized to increase the field or electrically conductive material 101 might be utilized to load down the field to increase its losses as previously discussed. With an electrically conductive strip 101, it would be preferable, if space permits, for the bar to be rotated 90° to put a wide side of the strip in the field and thus enhance the shielding effect.

Figure 16C:
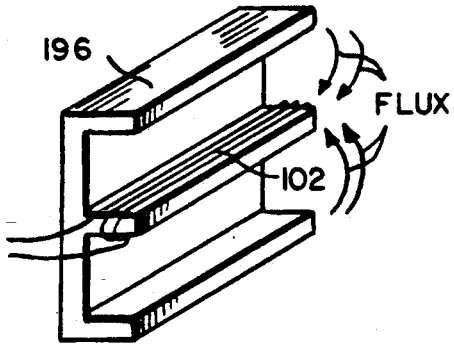

FIG. 16C shows another possible coil form, in this case an E-shaped coil form 196, which may be utilized for focusing EMS energy.

To the extent operating in lower frequency ranges, focusing techniques such as those indicated above and the like, do not reduce stray EMF transmissions from the device sufficiently so as to not cause a problem for other equipment in the area, the device may be made tunable (i.e. both the oscillator and the tuning capacitors could be made variable), so as to permit the frequency of the device to be changed to a frequency which will not cause a problem with a particular device in the area. In addition, standard EMF shielding techniques could be utilized in the area of the transmitting coil to reduce stray EMF fields.

While for the preferred embodiments discussed above, only horizontal sashes have been shown, as discussed in U.S. Pat. No. 4,893,551, the technology described may also be utilized with vertical rising sash hoods employing one or more sashes, double hung walk in hoods or combination vertical and horizontal sliding sash hoods. The technology might also be employed in hoods having a single sash to obtain a high resolution indication of sash opening.

Thus, while the invention has been particularly shown and described above with reference to preferred embodiments, the foregoing and other changes in form and detail may be made therein by one skilled in the art without departing from the spirit and scope of the invention.

What is claimed is:

1. In a fume hood having an opening for access to the interior thereof and at least one ash for covering the opening, apparatus for sensing the extent to which the sash or sashes cover the opening comprising:

a source of electromagnetic energy of a selected AC frequency, which is in the range from 10 Hz to 200 MHz, said source including an oscillator of said selected frequency, and a transmitting element selectively mounted relative to said sashes, said transmitting element including a wire coil connected to said oscillator; and means responsive to said electromagnetic energy and to the positions of said sashes for generating an electrical signal which varies as a function of uncovered portions of said opening.

2. Apparatus as claimed in claim 1 wherein said generating means includes a wire coil detector for electromagnetic energy at the selected frequency, and means for controlling the amount of electromagnetic energy from said transmitting coil which reaches said wire coil detector as a function of uncovered sash opening.

3. Apparatus as claimed in claim 2 wherein at least one of said coils is in a bar which extends substantially across said opening and is adjacent said sashes.

4. Apparatus as claimed in claim 3 wherein said wire coil detector and the transmitting coil are mounted adjacent to each other in said bar, and wherein said means for controlling includes means mounted to said sashes for altering the amount of energy from the transmitting coil which reaches the detector coil when said altering means is adjacent said bar.

5. Apparatus as claimed in claim 4 wherein said altering means is a conductive strip which functions to reduce the electromagnetic energy reaching the detector.

6. Apparatus as claimed in claim 4 wherein said altering means is a magnetically permeable means positioned to increase the permeability of the path for electromagnetic energy from said transmitting coil to said detector coil, and thereby to enhance the energy reaching the detector coil.

7. Apparatus as claimed in claim 3 including a second bar extending substantially across said opening and adjacent said sashes, one of said coils being in said first bar and one of said coils being in said second bar.

8. Apparatus as claimed in claim 7 wherein said second bar is on the opposite side of said sashes from said first bar, and wherein said controlling means includes means mounted to the sashes for preventing energy from the directing coil from reaching the detector coil when the sash to which said means is mounted is between said bars.

9. Apparatus as claimed in claim 3 wherein one of said coils is mounted in said bar and the other coil is mounted to said sashes in a manner such that the transmitting coil and the detector coil are adjacent when the opening is closed, and means responsive to the electromagnetic energy received by said detector coil for generating said electrical signal.

10. Apparatus as claimed in claim 9 wherein some of said sashes, and the coils connected thereto, are at a different distance from said bar than other sashes and their coils, and wherein said generating means includes means to compensate for the difference in electromagnetic energy which is received at the detector coil resulting from said difference in distance.

11. Apparatus as claimed in claim 10 wherein said compensating means includes scale and offset means through which the outputs of said detector coils are passed.

12. Apparatus as claimed in claim 10 wherein said compensating means includes providing different numbers of turns on coils which are at different distances from said bar.

13. Apparatus as claimed in claim 1 wherein said generating means includes means for controlling the voltage across or the current flow in said coil as a function of the uncovered portion of said opening, and means responsive to said voltage or current for controlling said electrical signal.

14. Apparatus as claimed in claim 13 wherein said means for controlling voltage or current includes mean for controlling the loading on said coil as function of the uncovered portion of the opening.

15. Apparatus as claimed in claim 13 wherein said means for controlling voltage or current includes means for shielding energy returned to said coil and thus altering the voltage or current therein.

16. Apparatus as claimed in claim 13 wherein said coil is fixedly mounted across said opening adjacent said sashes, and wherein said shielding means include conductive strips mounted to said sashes so as to be opposite said bar in covered portions of said opening.

17. Apparatus as claimed in claim 13 wherein said means for controlling voltage or current includes means for enhancing the focusing of energy to said coil and thus the voltage or current therein.

18. Apparatus as claimed in claim 1 wherein said means for transmitting includes wire coils connected to selected first one or more of said sashes; and wherein said generating means includes detector wire coils connected to selected second one or more of said sashes.

19. Apparatus as claimed in claim 18 wherein the transmitting wire coils and the detector wire coils are connected adjacent to each other on the same one or more sashes; and wherein said generating means includes means mounted to the remaining sashes for altering the electromagnetic energy transferred from the transmitting coil to the detector coil when such means, and the sash affixed thereto, are adjacent the coils.

20. Apparatus as claimed in claim 19 wherein aid altering means is a conductive strip which functions as a shield for electromagnetic energy.

21. Apparatus as claimed in claim 19 wherein said altering means is a magnetically permeable means positioned to increase the permeability of the path for electromagnetic energy from said transmitting coil to said detector coil, and thereby to enhance the energy reaching the detector coil.

22. Apparatus as claimed in claim 18 wherein the selected second sashes are all of the sashes which are not selected first sashes, and wherein said detector coils are mounted so as to be adjacent a transmitting coil when the sashes to which the coils ar mounted overlap.

23. Apparatus as claimed in claim 2 wherein at least one of said wire coils is coiled in multiple sections.

24. Apparatus as claimed in claim 23 wherein one or more of said sections is removable to achieve a coil of a desired length without breaking the continuity of the coil.

25. Apparatus as claimed in claim 24 wherein said sections are connected in series, and including means for making electrical connection to remaining end sections of said coil.

26. Apparatus as claimed in claim 23 wherein said sections are conncted in parallel.

27. Apparatus as claimed in claim 26 wherein said detector coil is in sections and wherein aid generating means includes a separate threshold detector means for each of said section.

28. Apparatus as claimed in claim 1 wherein said wire coil is coiled flat.

29. Apparatus as claimed in claim 28 wherein said wire coil is in the form of a conductive film deposited on a substrate.

30. Apparatus as claimed in claim 29 wherein id generating means includes a wire coil detector, said detector coil being in the form of a conductive film deposited on a substrate.

31. Apparatus as claimed in claim 1 wherein said coil is wrapped on a coil form of a magnetically permeable material to enhance the electromagnetic energy.

32. Apparatus as claimed in claim 31 wherein said coil form is C-shaped with said coil being wrapped on a center section.

33. Apparatus as claimed in claim 31 wherein said coil form is E-shaped, having a back portion with three projecting legs, and wherein said coil is wrapped on a center one of said legs.

34. Apparatus as claimed in claim 31 wherein said coil form is a bar on which said coil is wrapped.

35. Apparatus as claimed in claim 1 wherein said electrical signal varies substantially continuously as a function of uncovered portions of said opening.

36. Apparatus as claimed in claim 1 wherein said selected frequency is in the range form 10 KHz to 100 KHz.

37. Apparatus as claimed in claim 1 including means for inhibiting electromagnetic radiation from said apparatus.

38. Apparatus as claimed in claim 2 wherein at least said detector coil is of enhanced width, whereby the sensitivity of the coil to variations in distance between coils is reduced.

39. Apparatus as claimed in claim 38 wherein at least one of said coils is flexible so as to have its length adjustable to fit the width of a sash on which it is to be mounted, the width of the coil increasing as its length is decreased.

* * * * *